US011306451B2

(12) United States Patent
Turner et al.

(10) Patent No.: US 11,306,451 B2
(45) Date of Patent: Apr. 19, 2022

(54) DECK SYSTEM

(71) Applicant: Turner Vault Company, Northwood, OH (US)

(72) Inventors: Steven D. Turner, Toledo, OH (US); Bryan W. Martin, Whitehouse, OH (US)

(73) Assignee: Turner Vault Company, Northwood, OH (US)

( * ) Notice: Subject to any disclaimer, the term of this patent is extended or adjusted under 35 U.S.C. 154(b) by 49 days.

(21) Appl. No.: 16/795,862

(22) Filed: Feb. 20, 2020

(65) Prior Publication Data

US 2020/0270829 A1 Aug. 27, 2020

Related U.S. Application Data

(60) Provisional application No. 62/810,000, filed on Feb. 25, 2019.

(51) Int. Cl.

| | |
|---|---|
| ***E01D 19/00*** | (2006.01) |
| ***E01D 19/12*** | (2006.01) |
| ***E04B 1/00*** | (2006.01) |
| ***E04B 5/08*** | (2006.01) |

(52) U.S. Cl.
CPC ..... *E01D 19/125* (2013.01); *E04B 1/003* (2013.01); *E04B 5/08* (2013.01)

(58) Field of Classification Search
CPC ..... E01D 19/125; E04B 1/003; E04B 15/08; E04B 5/08
USPC ..... 14/73–78; 404/17–71; 52/251–262, 272, 52/283
See application file for complete search history.

(56) References Cited

U.S. PATENT DOCUMENTS 2,396,045 A * 3/1946 Henderson ..... E04B 1/21 52/283
4,972,537 A * 11/1990 Slaw, Sr. ..... E01D 19/125 14/73
5,025,522 A * 6/1991 Eskew ..... E01D 19/125 14/6
5,339,475 A * 8/1994 Jaeger ..... E01D 2/02 14/73
5,634,308 A * 6/1997 Doolan ..... E01D 2/00 14/73
5,802,652 A * 9/1998 Smith ..... E01D 19/125 14/73
5,870,789 A * 2/1999 Carranza-Aubry ..... E01D 2/02 14/73

(Continued)

*Primary Examiner* — Raymond W Addie
(74) *Attorney, Agent, or Firm* — Schaffer, Schaub & Marriott, Ltd.

(57) ABSTRACT

A deck system is disclosed having a mounting plate with a planar support surface and at least one locating rod extending from the support surface. The locating rod extends in a direction that is substantially perpendicular to the support surface. A beam having a first end and a second end is positioned on the support surface of the mounting plate. The first and second ends of the beam have a slot and the slot is disposed for receiving the locating rod. At least one tread is disposed to extend between the two spaced apart parallel oriented beams. The tread has opposed shoulders on the side of the tread that engages the spaced apart beams. The opposed shoulders are disposed for engaging a side of the spaced apart beams that are in adjacent relationship.

14 Claims, 7 Drawing Sheets

(56) References Cited

U.S. PATENT DOCUMENTS

| | | | | |
|---|---|---|---|---|
| 5,906,084 | A | 5/1999 | Millington et al. | |
| 6,574,818 | B1 * | 6/2003 | Matiere | E01D 2/04 14/73 |
| 7,000,279 | B2 * | 2/2006 | Szekely | E01C 11/24 14/69.5 |
| 7,461,427 | B2 * | 12/2008 | Ronald | E01D 19/125 14/77.1 |
| 7,475,446 | B1 * | 1/2009 | He | E01D 2/02 14/73 |
| 8,302,362 | B2 | 11/2012 | Rischmueller et al. | |
| 8,522,505 | B2 | 9/2013 | Beach et al. | |
| 8,839,588 | B2 | 9/2014 | Philbin et al. | |
| 9,096,975 | B2 | 8/2015 | Rischmueller et al. | |
| 11,001,978 | B2 * | 5/2021 | Nishino | E01D 19/12 |
| 2006/0201091 | A1 * | 9/2006 | Lockwood | E21D 11/08 52/380 |

* cited by examiner

DECK SYSTEM

CROSS-REFERENCE

The present patent application is based upon and claims the benefit of provisional patent No. 62/810,000, filed Feb. 25, 2019.

BACKGROUND OF THE INVENTION

The invention is directed to a deck system that can be utilized to span areas that are not easily traversed by pedestrian or vehicle traffic. In particular, the deck system is frequently used to extend over water or marshy areas that otherwise could not easily be traversed. The deck system utilizes reinforced concrete components that can resist the elements much more readily than treated wood decking systems that have been used in the past.

SUMMARY OF THE INVENTION

A deck system is disclosed having a mounting plate with a planar support surface and at least one locating rod extending from the support surface. The locating rod extends in a direction that is substantially perpendicular to the support surface. A beam having a first end and a second end is positioned on the support surface of the mounting plate. The first and second ends of the beam have a slot and the slot is disposed for receiving the locating rod. At least one tread is disposed to extend between the two spaced apart parallel oriented beams. The tread has opposed shoulders on the side of the tread that engages the spaced apart beams. The opposed shoulders are disposed for engaging a side of the spaced apart beams that are in adjacent relationship.

IN THE DRAWINGS

DETAILED DESCRIPTION OF THE INVENTION

Figure 1:
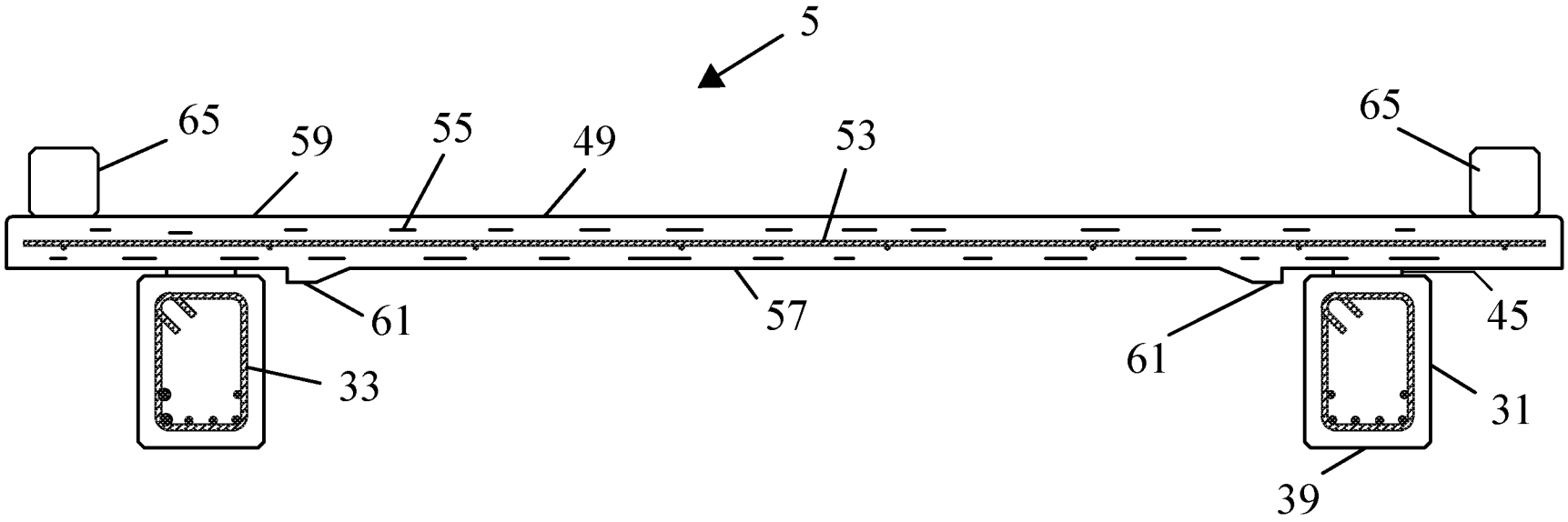
FIG. 1 is an end elevational view of the deck system of the invention.
Figure 2:
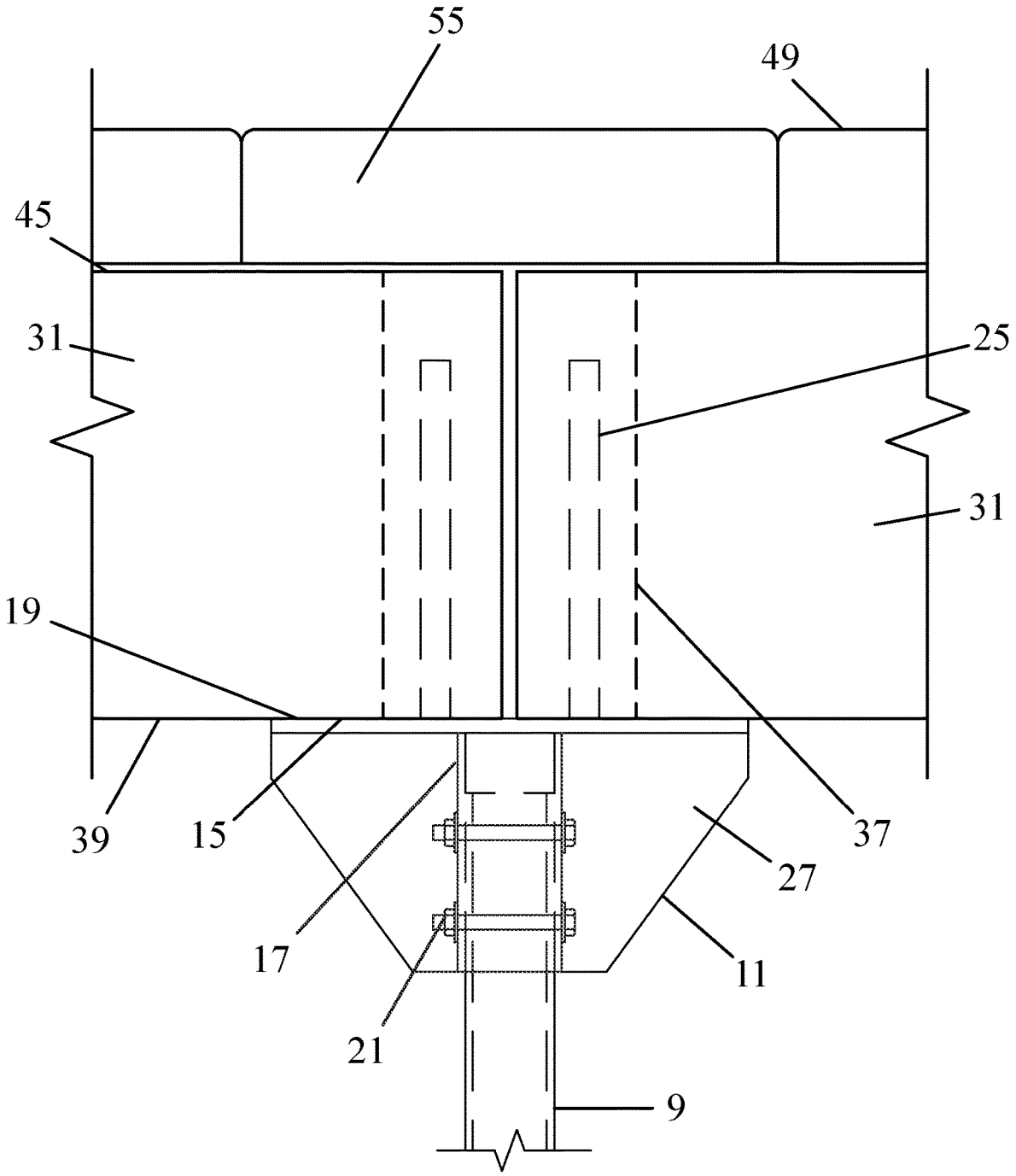
FIG. 2 is a partial side elevational view of the support for the deck system.
Figure 3:
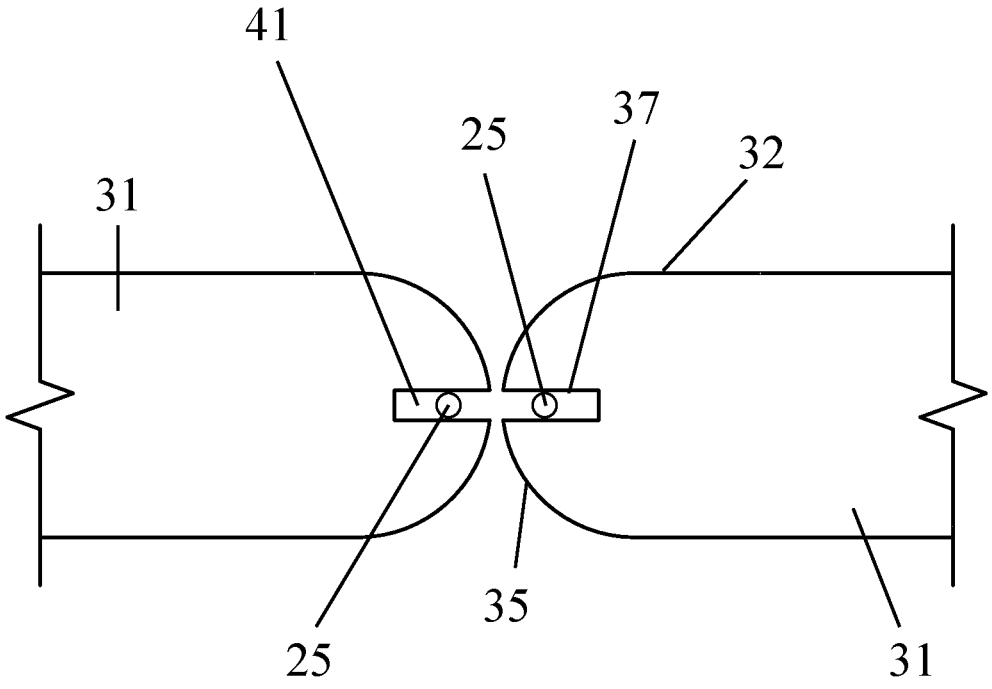
FIG. 3 is a partial top elevational view of the support beams.
Figure 4:
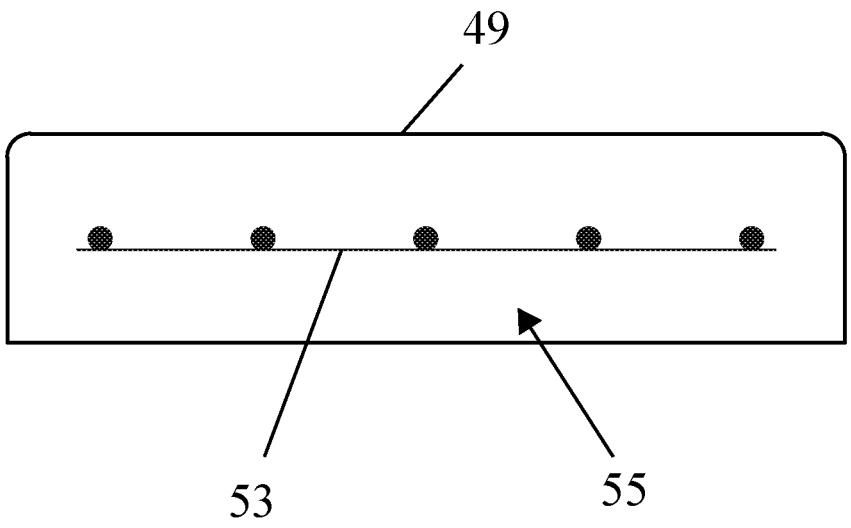
FIG. 4 is a cross sectional view of a tread of the deck system.
Figure 5:
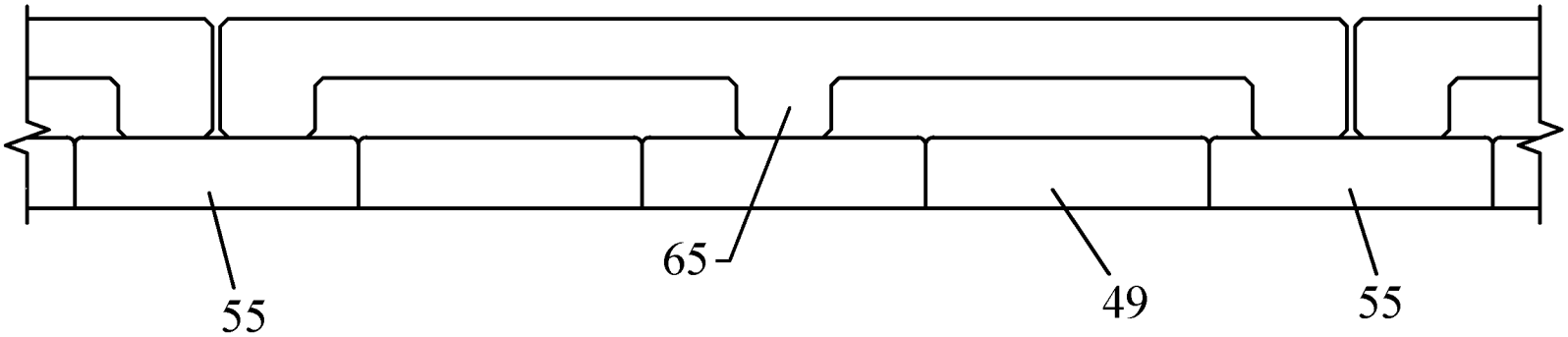
FIG. 5 is a partial side elevational view.

The invention is directed to a deck system designed to be used in areas that are suitable for walking or vehicle traffic. More particularly, the deck system is made primarily of reinforced concrete that can accommodate many environmental conditions and provide a safe and long-lasting deck system. The features of the invention will be more readily understood by referring to the attached drawings in connection with the following description.

The deck system 5, as shown in FIGS. 1-7, is designed to be mounted on piers 9 that are positioned in and extend above the land or water where the deck system is to be utilized. A concrete or metal style of pier can be used in the system. A helical pier that can be screwed into the ground has been found to be particularly useful for establishing a base for the deck system. A mounting cap 11 is positioned on the end of each of the piers 9. The mounting cap is positioned on the end of the pier that is spaced apart from the land or water where the pier is located. The mounting cap has a mounting plate 15 and sleeve 17 that extends from the mounting plate in a direction that is substantially perpendicular to a planar support surface 19 formed by the mounting plate 15. The sleeve 17 is designed to fit over the pier upon which the camp 11 is positioned. Bolts 21, or other securing devices, can extend through the sleeve 17 and the pier 9 to secure the mounting plate to the pier. At least one locating rod 25 extends from the side of the mounting plate 15 that is spaced apart from the sleeve 17. The at least one locating rod extends from the planar support surface 19 in a direction that is substantially perpendicular to the planar support surface. Reinforcing gussets 27 can extend between the sleeve 17 and the mounting plate 15 to provide additional reinforcement for the mounting plate 15. Mounting plate 15 is usually made of steel or a similar material having sufficient structural strength. The steel can be galvanized or otherwise coated to protect the material of the mounting plate from environmental elements.

A support beam 31 is designed to extend between the mounting caps 11 positioned on adjacent piers 9. The support beams are made of reinforced concrete and have a generally rectangular cross-section. Steel reinforcing bars 33 are usually positioned in the support beams to provide additional strength. The steel reinforcing bars can be galvanized or otherwise coated to protect the steel from environmental conditions. Each end of the support beam 31 has a radiused or curved section 35 and a slot 37 positioned in the curved section that extends from the bottom to the top of the support beam. The slot 37 is disposed to be in alignment with one of the locating rods 25 positioned on the planar support surface 19 of the mounting plate 15. The curved section 35 allows one support beam to be positioned at an angle with respect to an adjacent support beam to accommodate changes in direction for the deck system. The slot 37 and locating rod 25 also facilitate the positioning of the support beams in the desired orientation for the deck system. The bottom 39 of the support beam 31 is designed to rest upon the planar support surface 19 of the mounting cap 11.

An epoxy grout 41 can be positioned in the slot 37 on the support beam 31 to fill the slot around the locating rod 25. The epoxy grout 41 can also act to position the support beam with respect to the locating rod 25. A bearing pad 45 is positioned on the top of the support beam 31, which is the side of the support beam that is spaced apart from the mounting plate 15. The bearing pad 45 has a thickness that is from about ⅛ of an inch to about ¾ of an inch and is made from an elastomeric material such as rubber, urethane or similar resilient materials.

A plurality of treads 49 are positioned to extend over spaced apart support beams 31 that are orientated in a parallel relationship. The treads are formed of reinforced concrete with reinforcing steel 53 positioned substantially in the center of the treads. The reinforcing steel has a coating or protective material on the surface of the steel to protect the steel from the effects of moisture or other environmental conditions. The ends 51 of the treads 49 are designed to extend beyond the support beams 31 that support the treads. The concrete that is used in the treads is reinforced with reinforcing fibers 55 that are distributed substantially uniformly in the concrete. It has been found that a helix type of steel reinforcing fiber is particularly good at reinforcing the treads. Fibers sold by Helix Steel under the name twisted steel micro-rebar are one example of such a preferred reinforcing fiber. The use of helix type of reinforcing fibers increases the strength of the treads and allows less concrete to be used. This significantly reduces the weight of the treads. The treads can be subjected to vibration during pouring of the concrete to assist in positioning the reinforcing fibers in the treads and away from the exterior surfaces of the treads. The reinforcing fibers usually have a length from about 10 mm to about 50 mm and a diameter from about 0.25 mm to about 0.75 mm. In practice it has been found that a length of about 25 mm and a diameter of about 0.50 mm for the reinforcing fibers is preferred. The helix fibers are usually coated with zinc or other suitable material that protects the fibers from moisture and environmental chemicals. Although a helix type of steel fiber has been described, it should be appreciated that other types of reinforcing fibers can also be used. It has been found preferable to use from about 35 pounds to about 60 pounds of helix reinforcing fibers per cubic yard of concrete. The treads 49 have a generally rectangular cross-section width of the tread is substantially greater than the height of the tread. The bottom 57 of the treads 49 rests upon the bearing pads 45 that is positioned on the top of the support beams 31. A shoulder 61 is positioned adjacent each end of the treads 49. The shoulder on each end of the tread is designed to be located so that it can engage the side of the support beam 31 that is adjacent to the opposed support beam that supports the treads. This location for the shoulder 61 positions the shoulders between the parallel support beams that are used to support the treads. The shoulders extend from the bottom 57 of the treads 49 in a direction towards the mounting cap 11 for a distance from about 2 to about 4 inches. The shoulders 61 are designed to engage the support beams 31 and to prevent the treads from moving any substantial lateral distance with regard to the support beams. Shoulders 61 also function to make sure that the support beams are located a proper distance apart, so the proper support is provided for the treads. The top 59 of the treads 49 provide a surface upon which a pedestrian, vehicle, or other similar types of traffic can advance.

Figure 6:
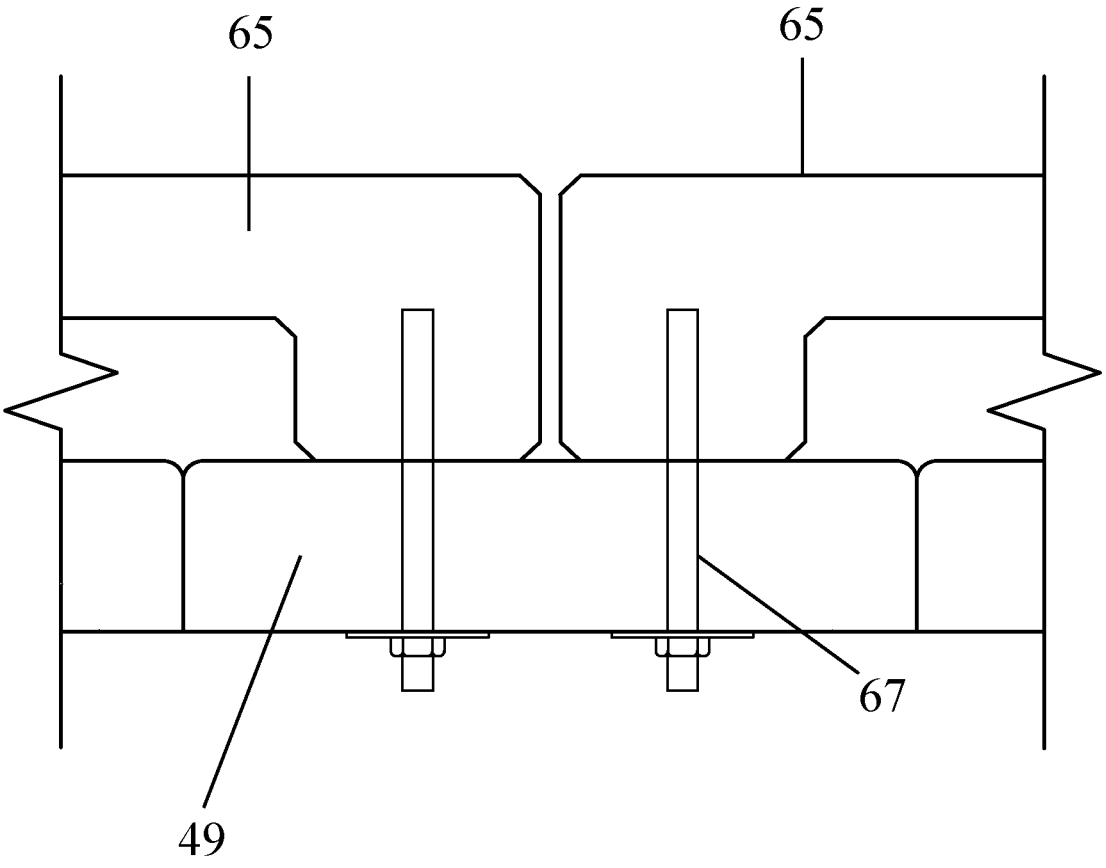
FIG. 6 is a partial side elevational view of a curb for the deck system.
Figure 7:
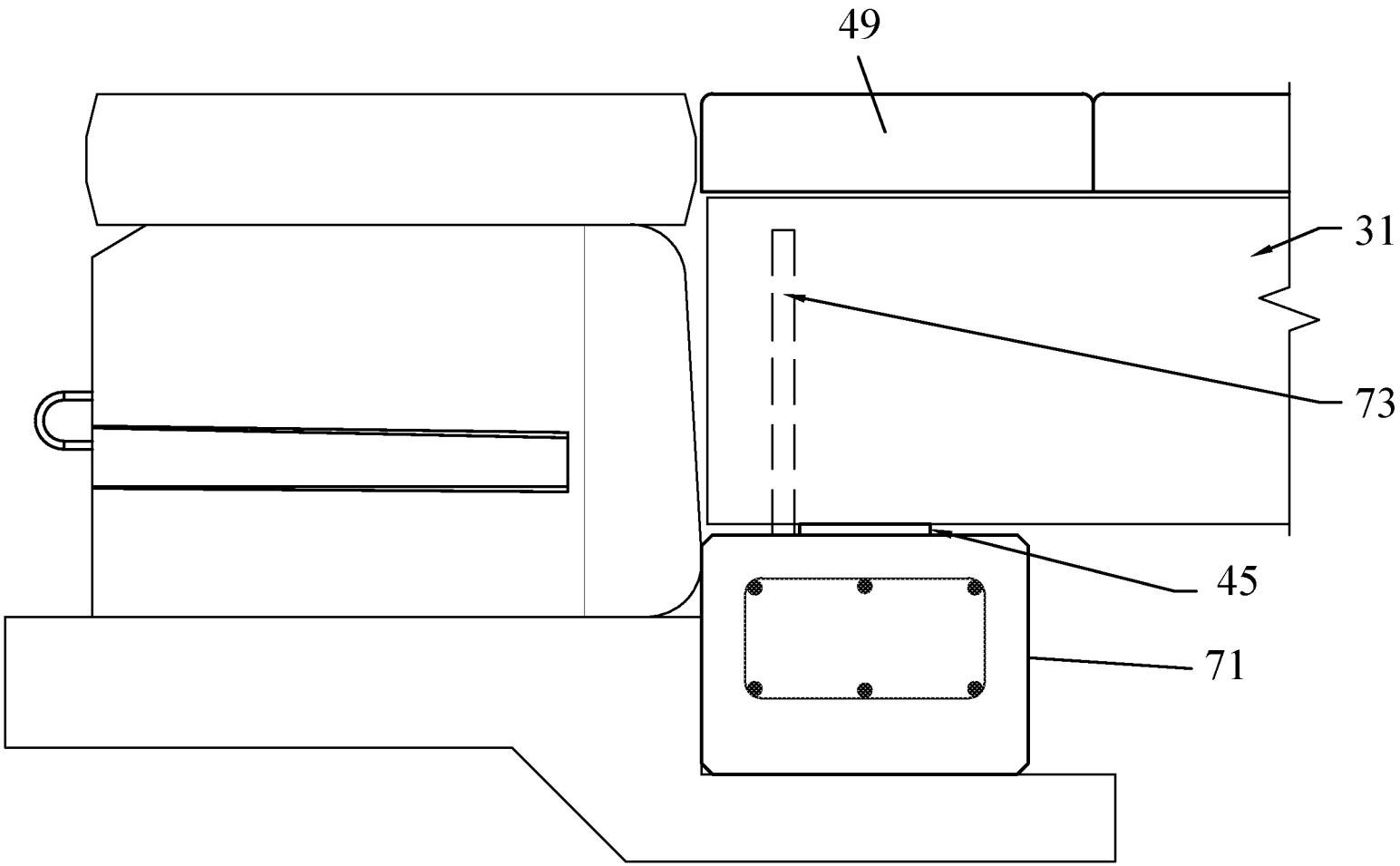
FIG. 7 is a partial side elevational view of the abatement for the deck system.

In some applications it may be desirable to have a curb 65 positioned on each end of the treads 49. The curbs, as shown in FIG. 6, are made of precast concrete and can be secured to the treads with a threaded rod 67 that extends through the treads 49 and into the curb 65. It should also be recognized that railings or similar structures can be mounted along the edges of the treads in a manner similar to the curbs. In some applications, as shown in FIG. 7, it may be desirable to position a bearing block 71 beneath the ends of the support beams 31 at the end of the deck system where the deck system transitions to the ground adjacent to the area that the deck system spanned. The bearing block is made of reinforced concrete utilizing the same type of reinforcing steel as previously described in this application. An anchor rod 73 extends from the top of the bearing block in a direction towards the support beam 31. The anchor rod 73 is designed to extend into the slot 37 on the end of the support beam to locate the support beam with respect to the bearing block 71. Epoxy grout 41 can be positioned in the slot 37 in the manner previously described.

In operation, the piers 9 are positioned in parallel rows in the ground where the deck system is to be utilized. Mounting caps 11 are positioned on each of the piers and support beams 31 are positioned on the planer support surface 19 of the mounting plate 15 of the mounting caps 11. The locating rods 25 extend into the slots 37 on the end of the support beams to ensure that the support beams are in the desired location on the mounting caps positioned on the piers 9. Epoxy grout 41 is used to fill the slots 37 and secure the support beams with respect to the locating rods 25. Depending on the length of the area that the decking system will span, several support beams 31 may be positioned on the plurality of parallel oriented piers 9. A plurality of treads 49 are positioned to extend between the support beams 31 that are positioned in spaced apart parallel relationship on the piers 9. The treads 49 can be positioned on top of a bearing pad 45 that can be positioned at the top of the support beams 30. The plurality of treads will extend along the length of the support beams 31 that span the area to be covered by the deck system 5. The shoulder 61 that is located on the bottom 57 of the treads 49 will be positioned adjacent the inside surface of the spaced apart parallel oriented support beams 31. The shoulder 61 is designed to engage the support beams to prevent any substantial movement of the treads in a direction that is perpendicular to the longitudinal axis of the support beams 31. In some applications, a bearing block 71 can be used at the end of the span that the deck system is to cover to provide a base upon which the ends of the support beams 31 can be positioned. A curb 65 can also be positioned adjacent the ends 51 of the treads 49 to provide a barrier to prevent pedestrians or vehicles from moving off the ends 51 of the treads 49. The curb 65 can be held in place with threaded rod 67 that extends through the treads 49 into the curbs.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A deck or walkway system comprising:

a mounting plate having a planar support surface and at least one locating rod extending from the support surface in a direction that is substantially perpendicular to the support surface;

a beam having a first end and a second end, the first and second ends of the beam being positioned on the support surface of a mounting plate, the first and second ends of the beam having curved sections, the first and second ends having a slot, the slot being disposed for receiving the locating rod, the locating rod positioning the beams in a desired location, the slot is disposed in the area of the first and second ends of the beam that contain the curved section, the slot extending from the curved section into the beam;

at least one planar tread, the at least one planar treat disposed to extent between two spaced apart but parallel beams, the planar tread having opposed shoulders on the side of the planar tread that engages the spaced apart beams, the opposed shoulders disposed for engaging a side of the spaced apart beams that are in adjacent relationship.

2. The system of claim 1 wherein the beam is made from concrete reinforced with steel reinforcing bars.

3. The system of claim 1 wherein the opposed shoulders extend from about 2" to about 4" from the side of the at least one tread that engages the spaced apart beams.

4. The system of claim 1 wherein a plurality of treads are disposed on spaced apart parallel beams.

5. The system of claim 1 wherein an epoxy grout is positioned in the slot to fill the portion of the slot adjacent the locating rod.

6. The system of claim 1 wherein a bearing pad is positioned on the side of the beam that is spaced apart from the mounting plate, the at least one tread disposed on the bearing pad.

7. The system of claim 1 wherein a curb is positioned adjacent the ends of the at least one planar tread.

8. The system of claim 1 wherein the at least one tread is made from concrete reinforced with steel reinforcing bars.

9. The system of claim 8 wherein reinforcing fibers are disposed in the concrete of the at least one tread.

10. The system of claim 9 wherein the reinforcing fibers are steel fibers with a protective coating.

11. The system of claim 10 wherein from about 35 to about 60 pounds of reinforcing fibers are provided for each cubic yard of concrete used to form the at least one tread.

12. The system of claim 11 wherein the reinforcing fibers are a helix shaped steel fiber.

13. The system of claim 12 wherein the helix shaped steel fibers have a protective coating, have a length from about 10 mm to about 50 mm and a diameter from about 0.25 mm to about 0.75 mm.

14. The system of claim 13 wherein the helix shaped steel fibers are substantially uniformly dispersed in the concrete of the at least one tread.

* * * * *